United States Patent [19]

Suzuki et al.

[11] 4,184,061

[45] Jan. 15, 1980

[54] BROWNING VESSELS WHICH USED TOGETHER WITH MICROWAVE OVENS

[75] Inventors: Katsuhiro Suzuki, Nagoya; Masaru Kinoshita, Otsu, both of Japan

[73] Assignees: Nippon Electric Glass Company, Limited, Shiga; Narumi China Corporation, Aichi, both of Japan

[21] Appl. No.: 884,601

[22] Filed: Mar. 8, 1978

[30] Foreign Application Priority Data

Mar. 11, 1977 [JP] Japan ..... 52-27433

[51] Int. Cl.[2] ..... H05B 9/06

[52] U.S. Cl. ..... 219/10.55 E; 99/DIG. 14; 219/10.55 F; 426/243

[58] Field of Search ..... 219/10.55 E, 10.55 M, 219/10.55 R, 521, 10.55 F; 425/174.2, 174.4, 174.6, 174.8 R; 426/107, 175, 234, 241, 243; 99/DIG. 14, 418, 451

[56] References Cited

U.S. PATENT DOCUMENTS

| | | | |
|---|---|---|---|
| 3,615,713 | 10/1971 | Stevenson | 219/10.55 E |
| 3,662,141 | 5/1972 | Schauer, Jr. | 219/10.55 E |
| 3,857,009 | 12/1974 | MacMaster et al. | 219/10.55 E |
| 3,934,106 | 1/1976 | MacMaster | 219/10.55 E |
| 3,941,968 | 3/1976 | MacMaster | 219/10.55 E |
| 3,943,320 | 3/1976 | Bowen | 219/10.55 E |
| 3,946,187 | 3/1976 | MacMaster | 219/10.55 E |
| 3,946,188 | 3/1976 | Derby | 219/10.55 E |
| 3,949,184 | 4/1976 | Freedman | 219/10.55 E |
| 3,965,323 | 6/1976 | Forker, Jr. | 219/10.55 E |
| 4,015,085 | 3/1977 | Woods | 219/10.55 E |
| 4,121,510 | 10/1978 | Frederick | 219/10.55 E |

*Primary Examiner*—Arthur T. Grimley
*Attorney, Agent, or Firm*—Kurt Kelman

[57] ABSTRACT

A microwave browning vessel is provided with an electroconductive film pattern comprising a plurality of, or three or four separated sections on a lower surface of a bottom wall thereof. A browning vessel is obtained which has a bottom wall of a relatively larger area of more than 550 $cm^2$, wherein the upper surface of the bottom wall is generally uniformly heated to uniformly brown the surface of foodstaff received on the bottom wall, when the vessel is used in the microwave oven. The area of each electroconductive film sections is restricted to 250 $cm^2$ or less, and the sum of the areas of the film sections is at least 50% of the upper surface of the bottom wall.

The vessel may be provided with a plurality of legs for supporting the vessel so that the lower surface of the bottom wall is maintained at a level of 1.0–1.7 cm higher than a surface on which the vessel is placed.

11 Claims, 4 Drawing Figures

BROWNING VESSELS WHICH USED TOGETHER WITH MICROWAVE OVENS

BACKGROUND OF THE INVENTION

This invention relates to browning vessels which are used together with microwave ovens, and, in particular, to improved vessels having a relatively wider bottom wall thereof and enabling to generally uniformly brown foodstuff received on the wider bottom wall.

To cook foodstuff in the use of a microwave oven, a vessel of heat resistant materials, such as a glass, glass ceramic, or ceramic vessel is used for containing foodstuff to be cooked. The vessel containing foodstuff is placed within a cooking chamber of the microwave oven to cook foodstuff.

The microwave cooking is advantageous in that foodstuff is rapidly and efficiently processed, but has a disadvantage that the surface of the cooked foodstuff is not browned.

To brown the surface of the cooked foodstuff, a browning vessel has been used, which is provided with an electroconductive film, or a tin oxide coating, on the lower surface of the bottom wall of a glass, glass ceramic, or ceramic vessel, or dish. The electroconductive film generates heat by internal currents generated by the microwave energy, and the generated heat is radiated to, and conducted to, the surface of foodstuff received on the upper surface of the bottom wall of the vessel to brown the surface of the cooked foodstuff.

In known browning vessels, a single electroconductive film with a predetermined pattern is coated on the lower surface of the bottom wall of the vessel, as is disclosed in U.S. Pat. No. 3,965,323.

The U.S. patent purposes to displace the electroconductive film coated on the lower surface above the lowermost support surface of the vessel and to form a bottom-open recess in the vessel, to promote a uniform heating of the coated area thus facilitating the utilization of larger areas providing uniform browning.

But, even if the proposal by the U.S. patent is employed, a uniform browning is not achieved, for example, by heating for a usual cooking time about 6–8 minutes using a microwave oven of a rated power of 600 watts, if the area of the bottom wall of the vessel is more than 450 $cm^2$, specifically in the vessel having a relatively wider bottom wall of an area of such as 550 $cm^2$ or more.

We found out following facts as to browning vessels having an electroconductive film on a lower surface of a bottom wall thereof, through our strict examination; (1) it is necessary for uniformly browning foodstuff that at least 60% of the upper surface area of the bottom wall of the vessel is elevated to a temperature of about 230° C. or more, (2) if the area of the electroconductive film is more than 250 $cm^2$, the browning temperature of about 230° C. is not obtained, (3) the temperature is readily elevated to a higher level at a peripheral portion of the electroconductive film, strictly stated at an outside and inside portion extending within 5 mm from the edge of the electroconductive film, than the other portion, and (4) if the electroconductive film has a sharp corner, the portion of the sharp corner is readily elevated to a higher portion than the other portion.

This invention is based on these our new knowledge.

SUMMARY OF THE INVENTION

An object of this invention is to provide a browning vessel for uniformly browning the surface of the cooked foodstuff in the use together with a microwave oven.

Another object of this invention is to provide a browning vessel having a bottom wall of a relatively larger area, for example, 550 $cm^2$ or more, which is utilized for uniformly browning foodstuff in contact with a bottom wall thereof, to facilitate the utilization of a space of a cooking chamber of a microwave oven.

The browning vessel according to this invention is characterized in that an electroconductive film pattern coated on the lower surface of the bottom wall of the vessel comprises a plurality of, advantageously, three or four smaller sections separated to one another so that each adjacent two sections are electrically non-conductive to one another.

According to an aspect of this invention, a browning vessel is obtained which has a plurality of, or three or four electroconductive film sections which are coated on at least 50% region of the lower surface of the bottom wall of the vessel, the area of the bottom wall being 550 $cm^2$ or more, and the area of each section being smaller than 250 $cm^2$. A gap between each adjacent two sections is 1.0–1.5 cm. The vessel may be provided with a plurality of legs of heat resistant materials to support the vessel so that the lower surface or the electroconductive films are maintained at a level of 1.0–1.7 cm higher than a surface on which the vessel is placed. Each corner of each electroconductive film section is formed in a rounded form.

Further objects, features and aspects of this invention will be understood from the following descriptions in connection with preferred embodiments of this invention referring to the annexed drawings.

DETAILED DESCRIPTION OF PREFERRED EMBODIMENTS

Figure 1:
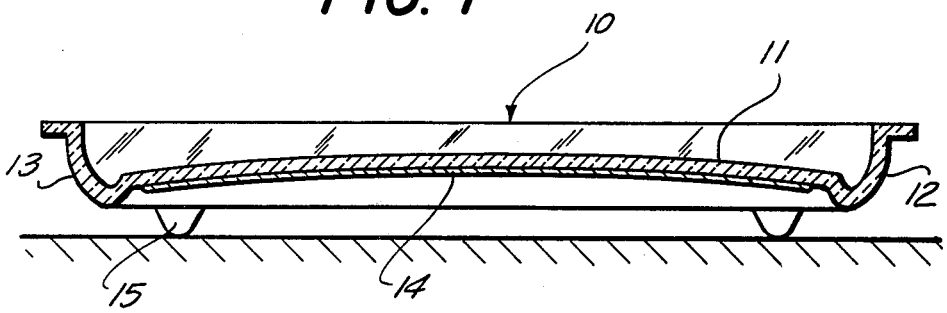
FIG. 1 schematically shows a sectional view of a browning vessel of an embodiment of this invention, FIG. 2 schematically shows a configuration of a bottom wall of the embodiment in FIG. 1 and illustrates temperature measuring points, FIG. 3 schematically shows a plan view of an electroconductive film pattern in the embodiment in FIG. 1, and FIG. 4 schematically shows a plan view of an electroconductive film pattern of another embodiment of this invention.

Referring to FIG. 1, a typical browning vessel or dish 10 comprises a glass, glass ceramic or ceramic dish in a rectangular form with rounded corners comprising a bottom wall 11 and a side wall 12. The side wall 12 extends along the circumference of the bottom wall 11, and the lower end of the side wall 12 is connected with the peripheral end of the bottom wall 11 through a circumferential recess or channel 13 surrounding the bottom wall 11. On the lower surface of the bottom wall 11, a pattern of electroconductive films, for example, of a tin oxide type 14 is coated. The pattern will be described in connection with FIG. 3.

A plurality of, for example, three legs 15 of heat resistant materials are fixed to the underside of the channel 13 to support the vessel 10 maintaining the lower surface of the bottom wall 11 at a predetermined level above a bottom surface of a cooking chamber of a microwave oven.

Figure 3:
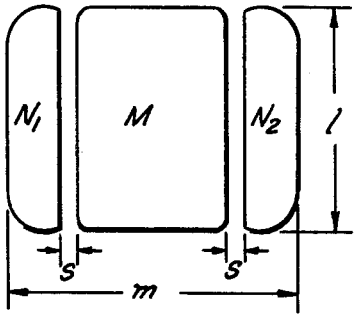

Referring to FIG. 3, the electroconductive film pattern 14 comprises three separated sections M, $N_1$, and $N_2$. The section M has a rectangular configuration, and two sections $N_1$ and $N_2$ of a rectangular configuration are disposed at opposite sides of, and adjacent to, the section M, with a gap between the section M and each of sections $N_1$ and $N_2$. The configuration of the entire pattern of the three sections M, $N_1$ and $N_2$ is also rectangular. Each corner of each rectangular section is actually rounded.

Tests were carried out for inspecting the temperature distribution on the upper surface of the bottom wall of the browning vessel, comparing a vessel having a known pattern of an electroconductive film. The vessel used in the tests was one as shown in FIG. 1 and in a generally rectangular form. The dimension of the bottom wall 11 was about 27 cm×22 cm, and, therefore, the area was about 590 $cm^2$. The electroconductive film pattern 14 had a dimension of about 24 cm×18 cm, and, therefore, an area of about 430 $cm^2$. The pattern 14 was so disposed on the lower surface of the bottom wall 11 that each side of the generally rectangular pattern is parallel to each side of the generally rectangular bottom wall. A plurality of, for example, three legs 15 were adjusted to maintain the lower surface of the bottom wall 11 at a predetermined level of 15 mm (Test No. 1) and 17 mm (Test No. 2) above a bottom surface of a cooking chamber of a microwave oven.

Figure 2:
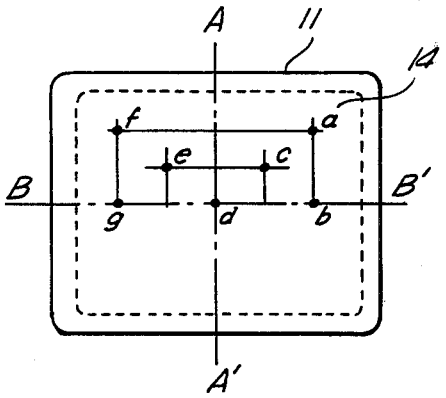

A plurality of temperature measuring points are illustrated in FIG. 2. Referring to FIG. 2, a configuration of the bottom wall 11 is shown by a solid line, and a configuration of the electroconductive film pattern 14 is shown by a broken line. The measuring points a, b and c are symmetric with the measuring points, f, g and e, respectively, in relation to an imaginary line A–A′ passing both midpoints of opposite longer sides of the bottom wall. The point d is at a center of the surface of the bottom wall 11. The point a is positioned at a distance of about 8 cm from the imaginary line A–A′ and at a distance of 6 cm from another imaginary line B–B′ passing both midpoints of opposite shorter sides of the bottom wall. The point b is positioned at a distance of 8 cm from the imaginary line A–A′ and on the other imaginary line B–B′. The point c is positioned at a distance of 4 cm from the imaginary line A–A′ and at a distance of 3 cm from the imaginary line B–B′.

The browning vessel was placed within a cooking chamber of a microwave oven of a rated power of 600 watts and was heated by applying a microwave energy for a time period of 6 minutes. Then the temperatures at the measuring points a–g were measured.

Table 1 shows the result of Test 1 and Test 2 as to a vessel having an electroconductive film pattern comprising a single film, which is applied onto the entire surface within the configuration of the pattern 14 shown in FIG. 2 of the lower surface of the bottom wall 11 of the vessel.

Table 1

| Test number<br>Height of coating from locating surface | | 1<br>15 mm | 2<br>17 mm |
|---|---|---|---|
| Temperature (°C.) | a | 255 | 290 |
| | b | 170 | 210 |
| | c | 180 | 230 |
| | d | 160 | 215 |
| | e | 190 | 230 |
| | f | 210 | 215 |
| | g | 200 | 205 |

As will be noted from Table 1, the temperature at all points b–g except only one point a is lower than the temperature of about 230° C. which is necessary in order to obtain acceptable browning, in Test No. 1. In Test No. 2 where the level of coating was maintained higher, the number of points where the temperature is higher than the browning temperature of 230° C. was increased, but at four points the temperature was still lower than the browning temperature. Furthermore, the temperature at the point a was very higher than the browning temperature. Accordingly, uniform browning cannot be realized.

The result of similar tests is shown in Table 2, for the embodiment shown in FIGS. 1 and 3. The dimensions of electroconductive film sections are as follows; The width of each of sections $N_1$ and $N_2$ is 4.5 cm, the width of the other section M being 12.5 cm, the width of each gap between the section M and each section $N_1$ and $N_2$ being 1.25 cm and the length l of each section being 18 cm.

Table 2

| Test number<br>Height of coating from locating surface | | 1<br>15 mm | 2<br>17 mm |
|---|---|---|---|
| Temperature (°C.) | a | 250 | 255 |
| | b | 260 | 255 |
| | c | 250 | 250 |
| | d | 200 | 210 |
| | e | 260 | 260 |
| | f | 260 | 265 |
| | g | 260 | 260 |

As will be noted from Table 2, all of the points except only one point d are elevated to uniform temperatures of 250°–260° C. which are higher than the browning temperature of about 230° C.

Further experiments were repeatedly performed with variations of dimensions of each section and each gap, and of the height of the electroconductive film. The experiments taught us that the width of each gap should be restricted to 1.0–1.5 cm, and that the height of the coating should be restricted to 1.0–1.7 cm. When the gap is excessively wider, uniform temperature distribution is not achieved, and if the width of the gap is shorter, the separation of the coating is meaningless. When the height of the coating is less than 1 cm, the heat generated at the bottom wall is disadvantageously absorbed by the shelf of the cooking chamber of the oven. If the height excesses 1.7 cm, greater temperature differential locally presents.

When the dimensions of each section are determined as follows; namely, the width of the section M being 12–13 cm, the width of each section $N_1$ and $N_2$ being 3.4–4.5 cm, and the length l being 16–18 cm, similar temperature distributions as Table 2 were realized.

Figure 4:
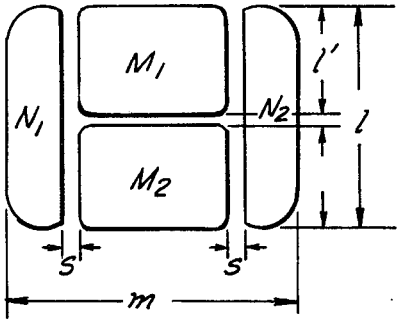

Referring to FIG. 4, the electroconductive film pattern of another embodiment of this invention is similar as the embodiment shown in FIG. 3 except that the central section is further separated into two sections $M_1$ and $M_2$ with a lateral gap. Two sections $M_1$ and $M_2$ are of a similar configuration and of a similar area.

The electroconductive film sections of the pattern shown in FIG. 4 was provided to the lower surface of the bottom wall of the vessel having a similar dimension in previous tests, and was subjected to similar tests. The employed dimensions of each section and each gap were similar as the Test Nos. 3 and 4, except that the length 1' of each section $M_1$ and $M_2$ was 8.5 cm, the gap between the sections $M_1$ and $M_2$ being 1 cm.

The result of the tests is shown in Table 3.

Table 3

| Test number | | 1 | 2 |
|---|---|---|---|
| Height of coating from locating surface | | 15 mm | 17 mm |
| Temperature (°C.) | a | 260 | 265 |
| | b | 265 | 265 |
| | c | 250 | 250 |
| | d | 200 | 200 |
| | e | 250 | 260 |
| | f | 260 | 260 |
| | g | 260 | 265 |

As will be noted from Table 3, the pattern of the embodiment in FIG. 4 can provide uniform temperature distribution, similarly as the embodiment in FIG. 3.

In the browning vessel of this invention, the sum of areas of electroconductive film sections is, at minimum, only 50% of the upper surface area of the bottom wall of the vessel. But, since there are small gaps of 1.0–1.5 cm between adjacent sections, the electroconductive film pattern substantially covers about 60% of the upper surface area. And, considering the aforementioned fact that the temperature is readily elevated to a higher level at a peripheral portion within 5 mm from the edge of the electroconductive film, the more than 60% region of the upper surface area of the bottom wall of the vessel is elevated to the browning temperature of about 230° C. or more, so that the uniform browning is maintained.

This invention enables to produce a browning vessel having a bottom wall of a layer area such as 550 $cm^2$ or more and, therefore, facilitates the utilization of larger areas of a space of a cooking chamber of a microwave oven.

This invention has been described in connection with preferred embodiments, which are only for exemplification. But, this invention is not restricted to those embodiments but various other designations and other modifications are easily made within the scope of this invention.

What is claimed is:

1. In a browning vessel for foodstuff which is adaptable to be used together with a microwave oven and which comprises a glass or glass ceramic dish having a wide bottom wall on which foodstuff is received, and an electroconductive film pattern coated onto a lower surface of said bottom wall, the improvement comprising said electroconductive film pattern comprising a plurality of separated film sections, each adjacent two sections being spaced from one another by a narrow non-electroconductive gap, each one of said electroconductive film sections being less than 250 $cm^2$ in area, the sum of the areas of said electroconductive film sections being at least 50% of the area of the surface of said bottom wall, and each corner of said electroconductive film sections being formed in a rounded form, whereby the bottom wall surface may be uniformly heated to uniformly brown foodstuff in use of said vessel together with said oven.

2. The improvement as claimed in claim 1, wherein said browning vessel has a plurality of heat resistant legs for stably supporting said dish so that said electroconductive film pattern is maintained at a level higher than a surface on which said vessel is placed.

3. The improvement as claimed in claim 1, wherein the upper surface area of said bottom wall is 550 $cm^2$ or more.

4. The improvement as claimed in claim 3, wherein said electroconductive film pattern comprises three separated film sections, a width of each of said narrow non-electroconductive gaps between adjacent sections being 1.0–1.5 cm.

5. The improvement as claimed in claim 3, wherein each of said film sections is in a rectangular form, with each corner of said each rectangular film section being rounded.

6. The improvement as claimed in claim 5, wherein said browning vessel has a plurality of heat resistant legs for stably supporting said dish so that said electroconductive film is maintained at a level higher by 1.0–1.7 cm than a surface on which said vessel is placed.

7. The improvement as claimed in claim 6, wherein said browning vessel is adaptable to be used within a microwave oven of a rated power of 600 watts.

8. The improvement as claimed in claim 3, wherein said electroconductive film pattern comprises four separated film sections, a width of each of said narrow non-electroconductive gaps between adjacent sections being 1.0–1.5 cm.

9. The improvement as claimed in claim 8, wherein each of said film sections is in a rectangular form, with each corner of said each rectangular film section being rounded.

10. The improvement as claimed in claim 9, wherein said browning vessel has a plurality of heat resistant legs for stably supporting said dish so that said electroconductive film is maintained at a level higher by 1.0–1.7 cm than a surface on which said vessel is placed.

11. The improvement as claimed in claim 10, wherein said browning vessel is adaptable to be used within a microwave oven of a rated power of 600 watts.

* * * * *